US010249984B1

(12) United States Patent
Rask

(10) Patent No.: US 10,249,984 B1
(45) Date of Patent: Apr. 2, 2019

(54) GRIP FOR SECURING A POWER CORD AT A RIGHT ANGLE

(71) Applicant: Steven Rask, Ogden, UT (US)

(72) Inventor: Steven Rask, Ogden, UT (US)

( * ) Notice: Subject to any disclaimer, the term of this patent is extended or adjusted under 35 U.S.C. 154(b) by 0 days.

(21) Appl. No.: 15/855,120

(22) Filed: Dec. 27, 2017

(51) Int. Cl.
*H01R 13/56* (2006.01)

(52) U.S. Cl.
CPC ..... *H01R 13/562* (2013.01)

(58) Field of Classification Search
CPC ... H01R 13/562; H01R 13/6395; H01R 13/56
USPC ..... 439/445, 447, 373
See application file for complete search history.

(56) References Cited

U.S. PATENT DOCUMENTS

| | | | | |
|---|---|---|---|---|
| 3,955,870 | A | 5/1976 | Wasserman | |
| 5,655,924 | A | 8/1997 | Cross et al. | |
| 6,071,142 | A * | 6/2000 | Blackman | H01R 13/6395 439/373 |
| 6,428,333 | B1 | 8/2002 | Rust | |
| 6,769,930 | B1 * | 8/2004 | McDevitt, Jr. | H01R 13/6395 439/373 |
| 6,939,161 | B1 * | 9/2005 | Yi | H01R 13/6395 439/373 |
| 7,004,782 | B2 | 2/2006 | Kroenung | |
| 7,056,145 | B2 | 6/2006 | Campbell, III et al. | |
| 7,134,902 | B1 * | 11/2006 | Lewis | H01R 13/6395 439/373 |
| 7,722,380 | B1 * | 5/2010 | West | H01R 13/6395 439/373 |
| 7,857,654 | B2 | 12/2010 | West et al. | |
| 2008/0076291 | A1 * | 3/2008 | Ewing | H01R 13/5812 439/373 |
| 2013/0183855 | A1 * | 7/2013 | Warner | H01R 13/6395 439/536 |
| 2015/0340809 | A1 * | 11/2015 | Lin | H01R 9/18 439/345 |

FOREIGN PATENT DOCUMENTS

| | | |
|---|---|---|
| WO | WO2010111045 | 9/2010 |

* cited by examiner

*Primary Examiner* — Gary F Paumen

(57) ABSTRACT

A grip for securing a power cord at a right angle thereby pulling a power cord at a right angle relative to an outlet includes a tube that is removably mounted on a power cord. The tube has a front end, a back end and an outer surface that extends between the front end and the back end. The outer surface has a slot that extends into an interior of the tube through the front and back ends wherein the power cord is slidably movable through the slot. A plurality of legs is attached to the tube and abuts a vertical wall that has an outlet therein to retain the tube in a perpendicular orientation with respect to the vertical wall. The tube retains the power cord at a perpendicular orientation with respect to the outlet to facilitate the plug to be removed from the outlet at a right angle.

13 Claims, 4 Drawing Sheets

GRIP FOR SECURING A POWER CORD AT A RIGHT ANGLE

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to power cord support devices and more particularly pertains to a new power cord support device for pulling a power cord at a right angle relative to an outlet.

BRIEF SUMMARY OF THE INVENTION

An embodiment of the disclosure meets the needs presented above by generally comprising a tube that is configured to be removably mounted on a power cord. The tube has a front end, a back end and an outer surface that is attached to and extends between the front end and the back end. The outer surface has a slot that extends therethrough into an interior of the tube. The slot extends through the front end and the back end wherein the power cord is slidably movable through the slot. A plurality of legs is attached to the tube wherein each of the legs has a distal end. Each of the legs is configured to be abutted against a vertical wall that has an outlet therein and retain the tube in a perpendicular orientation with respect to a planar surface against which the legs are abuttable. The tube is configured to retain the power cord at a perpendicular orientation with respect to the outlet to facilitate the plug to be removed from the outlet at a right angle with respect to the outlet.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
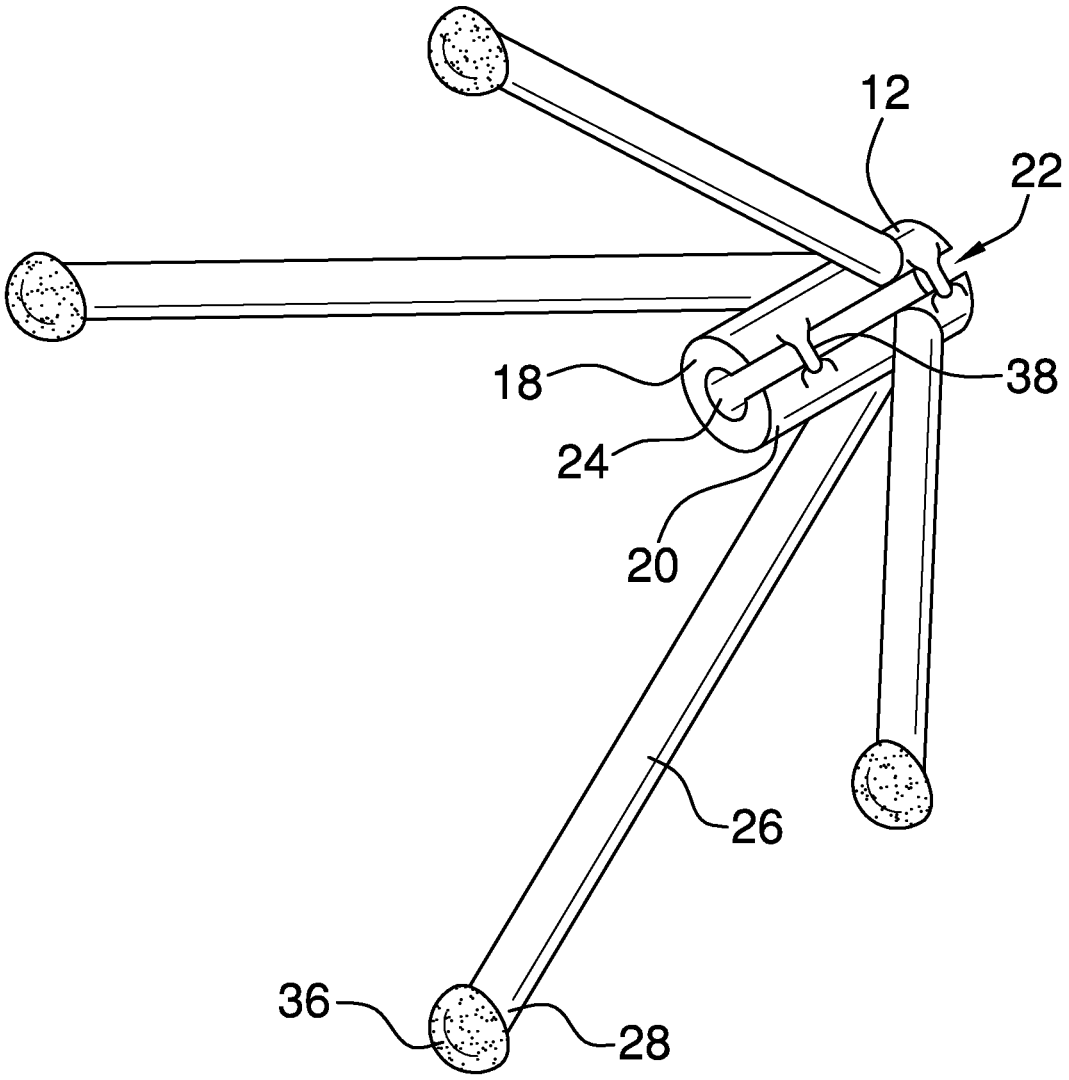
FIG. 1 is a top side view of a grip for securing a power cord at a right angle according to an embodiment of the disclosure.
Figure 2:
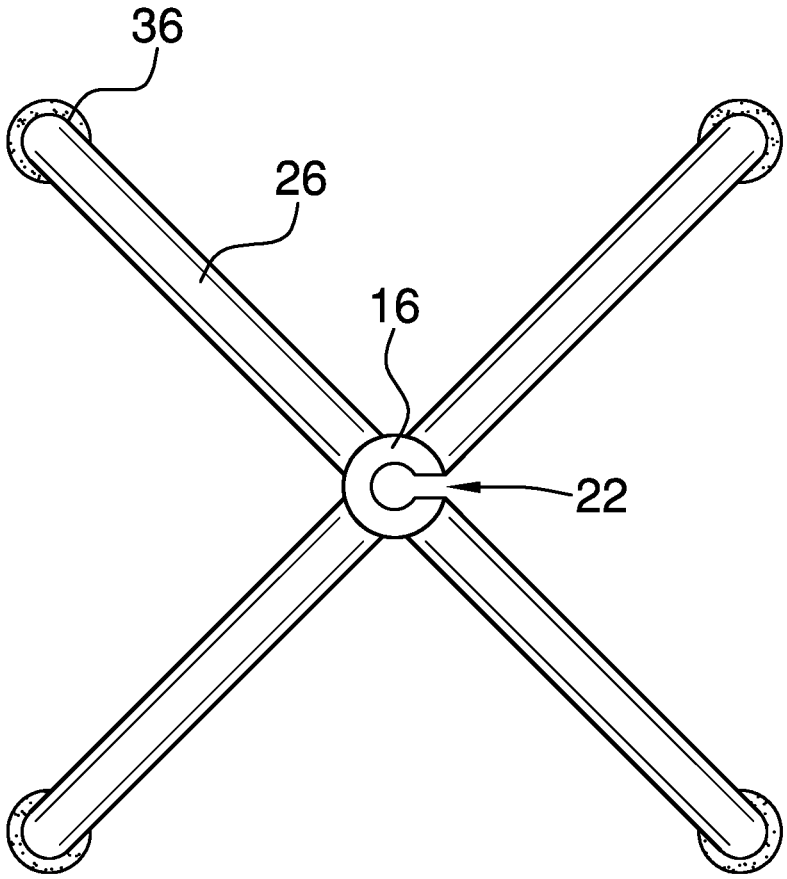
FIG. 2 is a front view of an embodiment of the disclosure.
Figure 3:
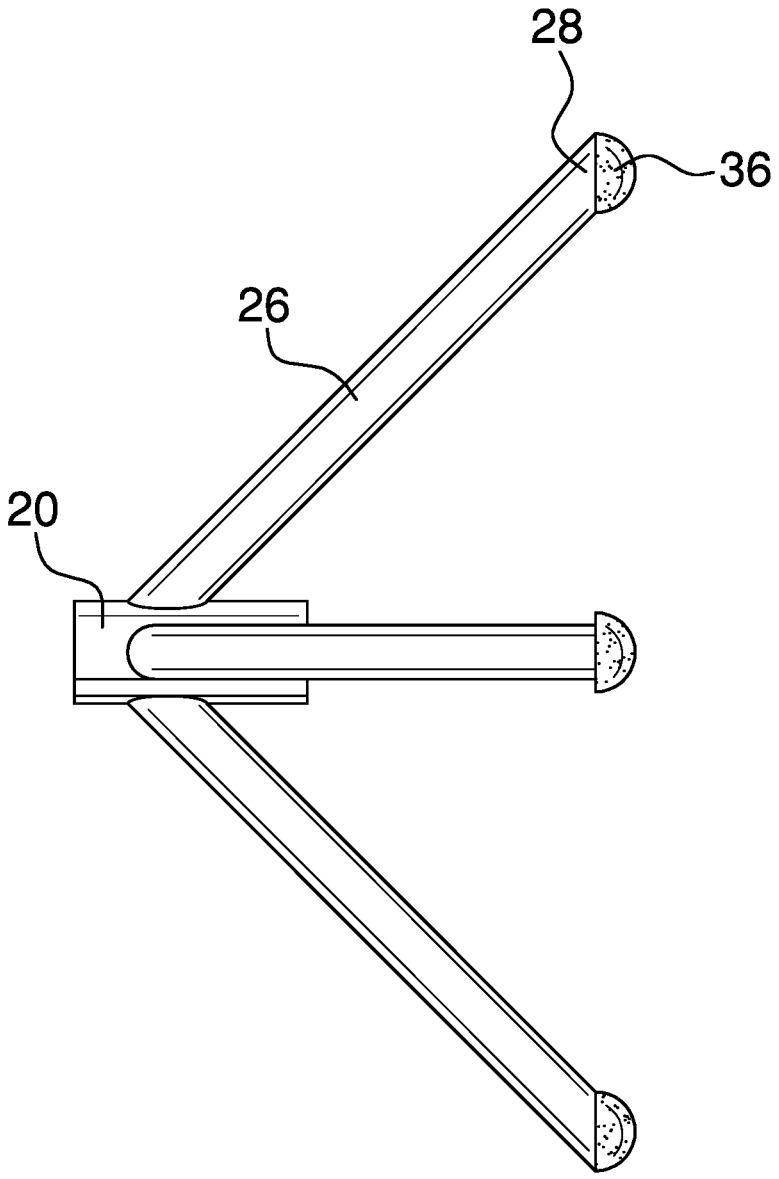
FIG. 3 is a side view of an embodiment of the disclosure.
Figure 4:
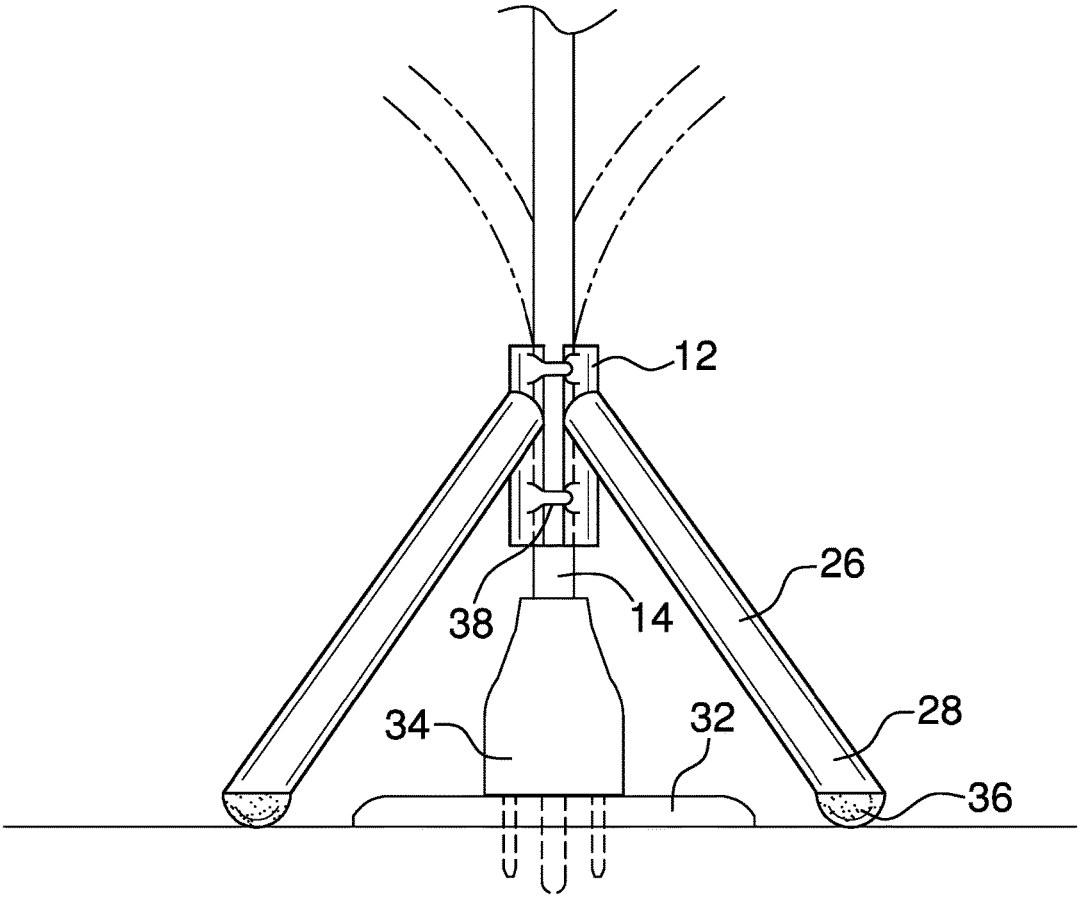
FIG. 4 is a top view of an embodiment of the disclosure.

With reference now to the drawings, and in particular to FIGS. 1 through 4 thereof, a new power cord support device embodying the principles and concepts of an embodiment of the disclosure and generally designated by the reference numeral 10 will be described.

As best illustrated in FIGS. 1 through 4, the grip for securing a power cord at a right angle 10 generally comprises a tube 12 that is removably mounted on a power cord 14. The tube 12 has a front end 16, a back end 18 and an outer surface 20 that is attached to and extends between the front end 16 and the back end 18. The outer surface 20 has a slot 22 that extends therethrough into an interior 24 of the tube 12. The slot 22 extends through the front end 16 and the back end 18 wherein the power cord 14 is slidably movable through the slot 22.

A plurality of legs 26 is attached to the tube 12 wherein each of the legs 26 has a distal end 28. Each of the legs 26 abuts against a vertical wall 30 that has an outlet 32 therein. A distance between the tube 12 and a plane that extends through the distal ends 28 is at least 3.0 inches and accommodates a plug 34 of the power cord 14 to be positioned between the vertical wall 30 and the tube 12. Each of the legs 26 retains the tube 12 in a perpendicular orientation with respect to a planar surface against which each of the legs 26 are abuttable. The tube 12 retains the power cord 14 at a perpendicular orientation with respect to the outlet 32 which facilitates the plug 34 to be removed from the outlet 32 at a right angle with respect to the outlet 32. Each of the legs 26 is attached to the outer surface 20 and extends outwardly therefrom such that each of the legs spaced from each other and distributed evenly around the tube 12. Each of the legs 26 forms an acute angle with respect to the tube 12.

A plurality of feet 36 is included wherein each of distal ends 28 has one of the feet 36 attached thereto. Each of the feet 36 frictionally engages the vertical wall 30. Each of the feet 36 comprises an elastomeric material.

A fastener 38 is attached to the tube 12 and secures the power cord 14 in the tube 12. The fastener 38 is positioned on the outer surface 20 of the tube 12 adjacent to the slot 22. The fastener 38 extends over a top of the slot 22 and engages the tube 12 on an opposite end of the slot 22 relative to the fastener 38 and inhibits the power cord 14 from moving outwardly through the slot 22.

In use, the power cord 14 is slid into the tube 12 and the plug 34 is plugged into the outlet 32. The tube 12 is positioned such that each of the feet 36 abuts the vertical wall. Each of the legs 26 retains the tube 12 in a perpendicular orientation relative to the vertical wall 30. When the power cord 14 is pulled in any direction, the tube 12 retains the power cord 14 in a perpendicular orientation relative to the outlet 32 wherein the power cord 14 is removed from the outlet 32 at a right angle relative to the outlet 32 such that plug 34 of the power cord 14 does not break in the outlet 32.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A power cord brace assembly configured for preventing an extension cord prong from breaking in an electrical outlet, said assembly comprising:

a tube being configured to be removably mounted on a power cord, said tube having a front end, a back end and an outer surface being attached to and extending between said front end and said back end, said outer surface having a slot extending therethrough into an interior of said tube, said slot extending through said front end and said back end wherein the power cord is slidably movable through said slot;

a fastener being attached to said tube, said fastener securing the power cord in said tube, said fastener being positioned on said outer surface of said tube adjacent to said slot, said fastener extending over a top of said slot and engaging said tube on an opposite end of said slot relative to said fastener and inhibiting the power cord from moving outwardly through said slot; and a plurality of legs being attached to said tube, each of said legs being configured to be abutted against a vertical wall having an outlet therein, each of said legs having a distal end, each of said legs being configured to retain said tube in a perpendicular orientation with respect to a planar surface against which said legs are abuttable, said tube being configured to retain said power cord at a perpendicular orientation with respect to the outlet to facilitate the plug to be removed from the outlet at a right angle with respect to the outlet.

2. The power cord brace assembly according to claim 1, further including a distance between said tube and a plane extending through said distal ends being at least 3.0 inches and being configured to accommodate a plug of the power cord to be positioned between the vertical wall and said tube.

3. The power cord brace assembly according to claim 1, wherein each of said legs is attached to said outer surface and extending outwardly therefrom, each of said legs being spaced from each other and being distributed evenly around said tube, each of said legs forming an acute angle with respect to said tube.

4. The power cord brace assembly according to claim 1, further including a plurality of feet, each of distal ends having one of said feet attached thereto, each of said feet being configured to frictionally engage the vertical wall.

5. The power cord brace assembly according to claim 4, wherein each of said feet comprises an elastomeric material.

6. A power cord brace assembly configured for preventing an extension cord prong from breaking in an electrical outlet, said assembly comprising:

a tube being configured to be removably mounted on a power cord, said tube having a front end, a back end and an outer surface being attached to and extending between said front end and said back end, said outer surface having a slot extending therethrough into an interior of said tube, said slot extending through said front end and said back end wherein the power cord is slidably movable through said slot;

a plurality of legs being attached to said tube, each of said legs being configured to be abutted against a vertical wall having an outlet therein, each of said legs having a distal end, a distance between said tube and a plane extending through said distal ends being at least 3.0 inches and being configured to accommodate a plug of the power cord to be positioned between the vertical wall and said tube, each of said legs being configured to retain said tube in a perpendicular orientation with respect to a planar surface against which said legs are abuttable, said tube being configured to retain said power cord at a perpendicular orientation with respect to the outlet to facilitate the plug to be removed from the outlet at a right angle with respect to the outlet, each of said legs being attached to said outer surface and extending outwardly therefrom, each of said legs being spaced from each other and being distributed evenly around said tube, each of said legs forming an acute angle with respect to said tube;

a plurality of feet, each of distal ends having one of said feet attached thereto, each of said feet being configured to frictionally engage the vertical wall, each of said feet comprising an elastomeric material; and a fastener being attached to said tube, said fastener securing said power cord in said tube, said fastener being positioned on said outer surface of said tube adjacent to said slot, said fastener extending over a top of said slot and engaging said tube on an opposite end of said slot relative to said fastener and inhibiting the power cord from moving outwardly through said slot.

7. A power cord brace system configured for preventing an extension cord prong from breaking in an electrical outlet, said system comprising:

a power cord having a terminal end comprising a plug;

a vertical wall defining a wall;

an outlet being mounted in said wall and being electrically engageable with said plug;

a tube being removably mounted on said power cord, said tube having a front end, a back end and an outer surface being attached to and extending between said front end and said back end, said outer surface having a slot extending therethrough into an interior of said tube, said slot extending through said front end and said back end wherein said power cord is slidably movable through said slot;

a fastener being attached to said tube, said fastener securing said power cord in said tube, said fastener being positioned on said outer surface of said tube adjacent to said slot, said fastener extending over a top of said slot and engaging said tube on an opposite end of said slot relative to said fastener and inhibiting said power cord from moving outwardly through said slot; and a plurality of legs being attached to said tube, each of said legs being abuttable against said vertical wall, each of said legs having a distal end, each of said legs being retaining said tube in a perpendicular orientation with respect to said vertical wall against which said legs are abuttable, said tube retaining said power cord at a perpendicular orientation with respect to said outlet to facilitate said plug being removed from said outlet at a right angle with respect to said outlet.

8. The power cord brace system according to claim 7, further including a distance between said tube and a plane extending through said distal ends being at least 3.0 inches to accommodate said plug to be positioned between said vertical wall and said tube.

9. The power cord brace system according to claim 7, wherein each of said legs is attached to said outer surface and extending outwardly therefrom, each of said legs being spaced from each other and being distributed evenly around said tube, each of said legs forming an acute angle with respect to said tube.

10. The power cord brace system according to claim 7, further including a plurality of feet, each of distal ends having one of said feet attached thereto, each of said feet frictionally engaging said vertical wall.

11. The power cord brace system according to claim 10, wherein each of said feet comprises an elastomeric material.

12. The power cord brace system according to claim 11, further including a distance between said tube and a plane extending through said distal ends being at least 3.0 inches to accommodate said plug to be positioned between said vertical wall and said tube.

13. The power cord brace system according to claim 12, wherein each of said legs is attached to said outer surface and extending outwardly therefrom, each of said legs being spaced from each other and being distributed evenly around said tube, each of said legs forming an acute angle with respect to said tube.

* * * * *